US008869902B2

(12) United States Patent
Smith et al.

(10) Patent No.: US 8,869,902 B2
(45) Date of Patent: Oct. 28, 2014

(54) DYNAMIC SEAL PAD PLUNGER ARRANGEMENT

(75) Inventors: Jesse L. Smith, Kingfisher, OK (US); David A. Green, Highlands Ranch, CO (US); Robert E. Bender, Evergreen, CO (US)

(73) Assignee: Well Master Corp., Golden, CO (US)

( * ) Notice: Subject to any disclaimer, the term of this patent is extended or adjusted under 35 U.S.C. 154(b) by 362 days.

(21) Appl. No.: 13/506,464

(22) Filed: Apr. 20, 2012

(65) Prior Publication Data

US 2012/0273222 A1 Nov. 1, 2012

Related U.S. Application Data

(63) Continuation-in-part of application No. 13/374,830, filed on Jan. 17, 2012, and a continuation-in-part of application No. 12/586,736, filed on Sep. 25, 2009, now Pat. No. 8,201,629, and a continuation-in-part of application No. 12/460,099, filed on Jul. 14, 2009, now Pat. No. 8,162,053, and a continuation-in-part of application No. 11/715,216, filed on Mar. 7, 2007, now Pat. No. 7,748,448, and a continuation-in-part of application No. 12/217,756, filed on Jul. 8, 2008, now Pat. No. 7,793,728, which is a continuation of application No. 11/350,367, filed on Feb. 8, 2006, now Pat. No. 7,395,865.

(60) Provisional application No. 60/593,914, filed on Feb. 24, 2005.

(51) Int. Cl.
*E21B 43/12* (2006.01)
*E21B 23/08* (2006.01)
*F04B 47/12* (2006.01)

(52) U.S. Cl.
CPC ..... *E21B 43/121* (2013.01); *F04B 47/12* (2013.01)
USPC ..... 166/383; 166/68; 166/69; 166/169; 166/386; 166/372

(58) Field of Classification Search
None
See application file for complete search history.

(56) References Cited

U.S. PATENT DOCUMENTS

| | | | | |
|---|---|---|---|---|
| 5,427,504 | A * | 6/1995 | Dinning et al. | 417/59 |
| 2005/0056416 | A1 * | 3/2005 | Gray et al. | 166/68.5 |
| 2007/0267189 | A1 * | 11/2007 | Wells | 166/68 |

* cited by examiner

*Primary Examiner* — Zakiya W Bates
(74) *Attorney, Agent, or Firm* — Don Halgren

(57) ABSTRACT

A plunger system for maximizing the liquid lift potential of a plunger arranged for vertical travel in a conduit in a gas/oil production well. The plunger system comprises an elongated plunger body mandrel having an upper or first end and a second or lower end with a fluid transmitting bore extending longitudinally therethrough, from the second or lower end of the plunger body and into at least a central portion of the plunger body, a plurality of curvilinearly shaped, replaceable wear pads arranged in a controllably radially displaceable manner on the plunger body, and at least one fluid ejecting nozzle arranged extending through a side wall of the plunger body.

20 Claims, 2 Drawing Sheets

DYNAMIC SEAL PAD PLUNGER ARRANGEMENT

FIELD OF THE INVENTION

This present invention relates to plunger lift systems for oil and gas wells, and more particularly to a gas lift plunger with an improved assembly arrangement, and is a continuation in part application of Ser. No. 13/374,830, filed Jan. 17, 2012 and is a continuation-in-part application of Ser. No. 12/586,736, filed Sep. 25, 2009 and of Ser. No. 12/460,099 which is a re-filing of Ser. No. 12/313,279, and is a continuation-in-part application of Ser. No. 11/715,216 and also of Ser. No. 12/217,756, which is a continuation of Ser. No. 11/350,367, now U.S. Pat. No. 7,395,865 which was based upon Provisional Patent Application 60/593,914, filed 24 Feb. 2005, each of which is incorporated herein by reference in its entirety.

BACKGROUND OF THE INVENTION

Brief Summary of the Invention

The present invention comprises a split-pad plunger assembly for use in wells, particularly those wells producing natural gas as the primary hydrocarbon. The split-pad plunger assembly of the present invention is utilized to cyclically travel up and down, between the top of the well to the bottom of the well and back, to drive the bulk of the liquid present in its travel conduit, to the surface. The plunger assembly is comprised of an elongated hollow central core or mandrel. The elongated hollow core or mandrel consists of an elongated partially hollow first or front (upper) half and an elongated fully hollow second or back (lower) half, with a bore extending therethrough. Each front half and back half, at least in this preferred embodiment, is preferably the duplicate of the other half. The bore in one preferred embodiment is of uniform diameter along the length of its longitudinal axis "L". The bore extending through the mandrel, in another preferred embodiment, may be of tapered configuration. The taper of the bore would preferably be of narrowing diameter as the bore extends from the bottom or lower barrel end of the plunger assembly towards the top or upper end thereof. The bore in a further embodiment may be comprised of one or more pinched or narrowed diameter sections to have a venturi-like fluid flow effect on fluids passing through that bore.

The elongated hollow mandrel has a mid-portion with an annular circumferential securement ring ridge disposed centrally therearound. Each half of the mandrel has at least two sets of longitudinally spaced-apart radial arrays of supports.

A cylindrically shaped "retrieval-neck" is threadedly arranged longitudinally outwardly of the distal most annular array of supports at the upper or top end of the plunger assembly. A hollow barrel is threadedly received onto the lower or downwardly facing end of the plunger assembly. The retrieval neck preferably has a threaded bore extending therein which threadedly receives the screw threaded distal end of the central spine or mandrel. In a further embodiment, the retrieval neck is machined as part of a solid casting with the mandrel, and is irremovable therefrom. In yet a further embodiment of the plunger assembly, the hollow lower end barrel, herein designated as the "lower" end, for example purposes only, may have an annular, hollow protective sensor, for safely and replaceably enclosing proper wireless communicative electronic sensors and alarms, for sensing well casing pressure, time, distance, fluid composition, viscosity, chemical makeup and the like, and also maintaining report/control functions and/or an antennae for the plunger assembly. Such sensors may be in proper communication with sensors embedded within or on an array of arcuate wear pads. The hollow lower end barrel has a channel extending therethrough, to permit gaseous fluids to enter the bore within the mandrel.

Relative to the "wear functions" of the plunger assembly, an arrangement of, for example, four curved sealing-surface pads are circumferentially arranged about each mandrel half, so as to be radially slidingly supported adjacent the radially outer end of each radially directed support. The curved sealing-surface pads each have a cutout arranged on its longitudinally directed edges. Each cutout slidingly mates with the radially directed support. At least one radial bias spring is arranged between the central spine or mandrel adjacent each radially directed support. The radial bias springs act to radially outwardly bias the curved sealing surface pads against the inner side of the well's conduit in which the split-pad plunger assembly travels. The outward radial bias of the sealing-surface pads acts to minimize loss of pressure from the lower side of that conduit during movement of the plunger therein.

An arcuately segmented split retainer ring, preferably of semi-circumferential shape, is disposed about the mid-point of the central spine or mandrel, and has an annular lip which secures the other or "proximal" longitudinal edge of each curved sealing-surface pad in proper location about the central spine or mandrel.

An annular manifold is arranged circumferentially around at least one longitudinal location of preferably both the first half and the second half of the hollow elongated mandrel. Each manifold has a plurality of preferably replaceable fluid discharge nozzles arranged generally radially therein. In another embodiment, those nozzles are fixed orifices, generally radially configured within the annular manifold.

The gaseous fluid "G" entering the bore in the hollow lower end barrel pressurizably flows into the fluid communicative bore of the mandrel, and through the nozzles in the manifold, as the plunger assembly travels within the conduit "C" of the well. The jet-like fluid pressure of the well gaseous fluids traveling through the first lower bore in the hollow lower end barrel and into the bore within the elongated mandrel flows radially outwardly through the nozzles in the manifold, against the arcuate inner surface of the pads pushing them against the walls of the conduit "C". This outwardly directed bias force provides an improved sealing of the plunger assembly as it travels through the well's conduit "C". Further, the gaseous fluid escapes radially outwardly from within the plunger assembly, and into the conduit "C", keeping liquid from running back downhole via movement under the pads, and also helps keep the liquid on the top (above) of the plunger. That escaping gas thus also lightens the liquid load on above the plunger assembly, so less pressure is required to provide lift to a given amount of fluid above the plunger assembly. The biasing of the well gas "G" against the curved inside surface of the pads assists the springs in biasing the pads radially outwardly against the conduit "C", thus providing a tighter seal between the plunger assembly and the conduit "C" through which it is moving.

The replaceable nozzles may be replaced when pads are changed, should different gaseous flow rates be desired by the gas "G" from the central bore, against the inner surface of the wear pads.

Thus, gaseous fluids "G" enter the lower end of the plunger assembly through the central open channel in the hollow lower end barrel and into the main channel, the bore within the mandrel. The gas "G" enters the manifold and exits out the nozzles therein, and jets against the inner surface of the pads, biasing them radially outwardly, assisting the bias springs thereby. The gas "G" then also enters the conduit "C" and floats upwardly therein, lightning the load of the liquid on top of the plunger assembly, minimizing liquid escaping into the plunger assembly and minimizing liquid passage downwardly into the conduit "C".

The invention thus comprises a plunger system for maximizing the liquid lift potential of a plunger arranged for vertical travel in a conduit in a gas/oil production well, the plunger system comprising: an elongated plunger body mandrel having an upper or first end and a second or lower end with a fluid transmitting bore extending longitudinally therethrough, from the second or lower end of the plunger body and into at least a central portion of the plunger body; a plurality of curvilinearly shaped, replaceable wear pads arranged in a controllably radially displaceable manner on the plunger body; and at least one fluid ejecting nozzle arranged extending through a side wall of the plunger body, providing gaseous fluid communication from the bore within the mandrel to an inner surface of at least one of the wear pads on the plunger body, for directing pressurized fluid from the lower end of the plunger body onto the inner surface of the at least one pad for biasing the wear pad radially outwardly. The first or upper end of the plunger body has an attached cap member thereon. The second or lower end of the plunger body has a barrel member thereon. The barrel member has a bore extending longitudinally therethrough. The wear pads have a bias spring arranged between the plunger body and the inner surface of the wear pad to radially bias its adjacent wear pad radially outwardly. The nozzle is arranged as a part of a manifold. The nozzle in the manifold may be replaceable. Fluid is arranged to escape the plunger body around a periphery of a wear pad. The wear pad is guided by alignment members to help control radial displacement. The fluid transmitting bore extending longitudinally within the body of the plunger may in one embodiment be of tapered dimension.

The invention also comprises a method of improving the flow of liquid upwardly above an upwardly moving plunger in a conduit of an oil/gas production well, comprising one or more of the following steps: arranging a plunger system with an internal, gas communicating channel between a lower end thereof, and a generally radially directed nozzle extending through a body portion of the plunger; and ejecting gas through the generally radially directed nozzle and onto a radially inner side of a wear pad arranged radially displaceably on the body portion of the plunger, so as to bias the wear pad radially outwardly against the wall of the conduit for improved sealing between the plunger and the conduit of the well; permitting gas ejected from a nozzle to escape from the plunger between the wear pad and the body of the plunger so as to lighten the liquid above the plunger in the conduit of the well; arranging an annular array of nozzles in a manifold radially inwardly of an annular array of radially displaceable wear pads on the body of the plunger; biasing the wear pads against the conduit of the well, by a combination of gas pressure and biasing springs arranged radially outwardly on the body of the plunger.

The invention may also comprise a method of lightening the load of liquid above an upwardly moving plunger in a conduit of an oil/gas production well, comprising one or more of the following steps of: transmitting a flow of gas through a bore beginning in the lower end of the plunger and through a bore within the plunger; ejecting gas from at least one side nozzle in fluid communication with the bore within the plunger, the nozzle being arranged in a wall portion of the plunger, the well gas being biasedly ejected onto an inner side of a wear pad arranged on the wall of the plunger; bubbling the ejected gas through a route between a wear pad and the body of the plunger to permit the gas to escape into the liquid above the vertically moving plunger, and thus lighten that liquid load; and tapering the bore within the plunger so as to increase the velocity of the gas being ejected through a nozzle and against the inside surfaces of the wear pad.

BRIEF DESCRIPTION OF THE DRAWINGS

The objects and advantages of the present invention will become more apparent when viewed in conjunction with the following drawings, in which.

DETAILED DESCRIPTION OF THE PREFERRED EMBODIMENTS

Figure 1:
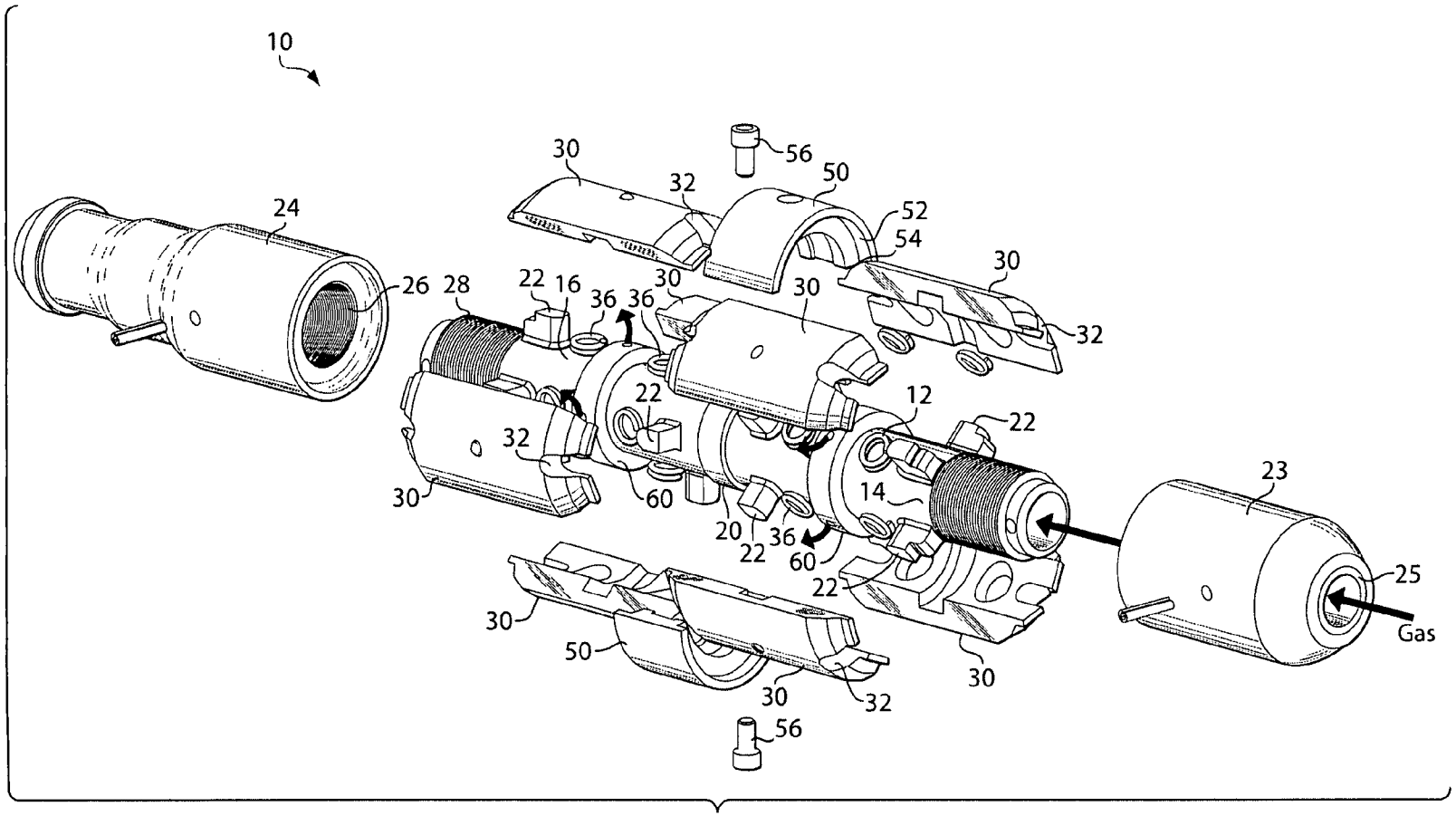
FIG. 1 is an exploded view, in perspective, of the plunger assembly of the present invention.
Figure 2:
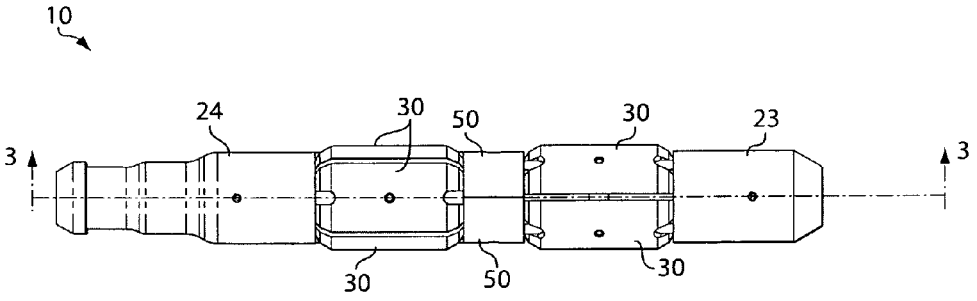
FIG. 2 is a side elevational view of the plunger in non-exploded view.
Figure 3:
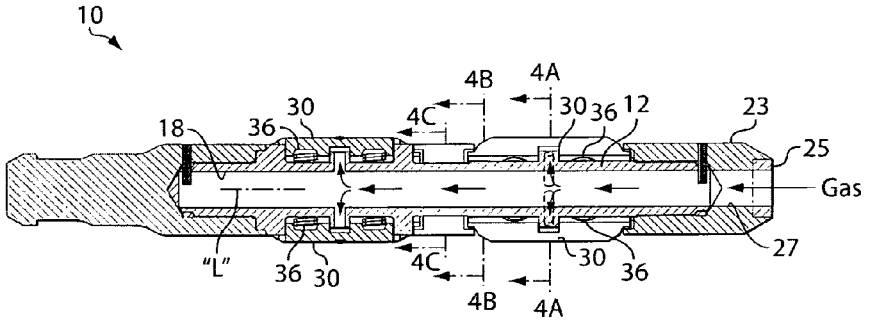
FIG. 3 is a sectional view of the plunger shown in FIG. 2, taken along the lines 3-3 therein.

Referring to the drawings in detail, and particularly to FIG. 1, there is shown in an "exploded" view, the present invention which comprises a split-pad plunger assembly 10 for use in wells, particularly those wells producing natural gas as the primary hydrocarbon. The split-pad plunger assembly 10 of the present invention, shown in an assembled embodiment in FIG. 2, is utilized to cyclically travel up and down, between the top of the well to the bottom of the well and back, to drive the bulk of the liquid present in its travel conduit, to the surface. The plunger assembly 10 is comprised of an elongated hollow central core or mandrel 12, shown in FIGS. 1 and 3. The elongated hollow core or mandrel 12 consists of an elongated hollow first half 14 and an elongated hollow second half 16, with a bore 19 extending therethrough, as best represented in FIG. 3. Each half 14 and 16, at least in this preferred embodiment, is preferably the duplicate of the other half 16 and 14. The bore 19 in one preferred embodiment is of uniform diameter along the length of its longitudinal axis "L", as represented in FIG. 3. The bore 19 extending through the mandrel 12, in another preferred embodiment, is of tapered configuration, not shown for clarity of the figures. The taper of the bore 19 would preferably be of narrowing diameter as the bore 19 extends from the bottom (lower) or barrel 25 end of the plunger assembly 10 towards the top or upper end thereof. The bore 19 in a further embodiment may be comprised of one or more pinched or narrowed diameter sections to have a venturi-like fluid flow effect on fluids passing through that bore 19.

The elongated hollow mandrel 12 has a mid-portion with an annular circumferential securement ring ridge 20 disposed centrally therearound. Each half 14 and 16 of the mandrel 12 has two sets of longitudinally spaced-apart radial arrays of wear pad alignment supports 22. A cylindrically shaped "retrieval-neck" 24 is threadedly arranged longitudinally outwardly of the distal most annular array of alignment supports 22 at the upper or top end of the plunger assembly 10 and a hollow barrel 23 is threadedly received onto the lower or downwardly facing end of the plunger assembly 10, as shown in FIGS. 1, 2 and 3. The retrieval neck 24 preferably has a threaded bore 26 extending therein which threadedly receives the screw threaded distal end 28 of the central spine or mandrel 12, as is seen in FIGS. 1 and 3. In a further embodiment, not shown, for ease of viewing, the retrieval neck 24 is machined as part of a solid casting with the mandrel 12, and is irremovable therefrom. In yet a further embodiment of the plunger assembly 10, the hollow lower end barrel 23, herein designated as the "lower" end, for example purposes only, may have an annular, hollow protective sensor 25, as represented in FIGS. 1 and 3, for safely and replaceably enclosing proper wireless communicative electronic sensors and alarms, for sensing well casing pressure, time, distance, fluid composition, viscosity, chemical makeup and the like, and also maintaining report/control functions and/or an antennae for the plunger assembly 10 as represented in our parent application Ser. No. 12/460,099, which is incorporated herein by reference. Such sensors may be in proper communication with sensors embedded within or on an array of arcuate wear pads 30, as represented in FIGS. 1-4A. The hollow lower end barrel 23 has a channel 27 extending therethrough, as seen in FIGS. 1 and 3, to permit gaseous well fluids to enter the bore 19 within the mandrel 12, for functions which are described in greated detail hereinbelow.

Relative to the "wear functions" of the plunger assembly 10, an arrangement of for example, four curved sealing-surface pads 30 are circumferentially arranged about each mandrel half 14 and 16, as represented in FIGS. 1, 2 and 3, so as to be radiatively slidingly supported adjacent the radially outer end of each radially directed support 22. The curved sealing-surface pads 30 each have a cutout 32 arranged on its longitudinally directed edges 34. Each cutout 32 slidingly mates with the radially directed support 22. A radial bias spring 36 is arranged between the central spine or mandrel 12 adjacent each radially directed support 22. The radial bias springs 36 act to radially outwardly bias the curved sealing surface pads 30 against the inner side of the well's conduit in which the split-pad plunger assembly 10 travels. The outward radial bias of the sealing-surface pads 30 acts to minimize loss of pressure (which pressure pushes the plunger) in the lower portion of that conduit during movement of the plunger 10 therein.

An arcuately segmented split retainer ring 50, preferably of for example, semi-circumferential shape, as represented in FIG. 1, is disposed about the mid-point of the central spine or mandrel 12, and has an annular lip 52 which secures the other or "proximal" longitudinal edge 54 of each curved sealing-surface pad 30 in proper location about the central spine or mandrel 12. Each set of split retainer rings 50 is held in place around its respective longitudinal mid-portion of the central spine or mandrel 12 by a bolt 56 extending therethrough.

Figure 4C:
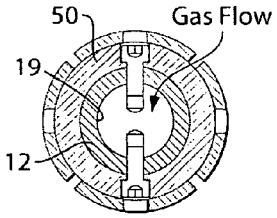
FIG. 4C is a transverse sectional view taken along the lines 4C-4C, of FIG. 3.
Figure 4B:
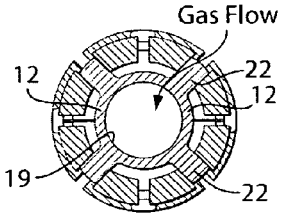
FIG. 4B is a transverse sectional view taken along the lines 4B-4B, of FIG. 3.
Figure 4A:
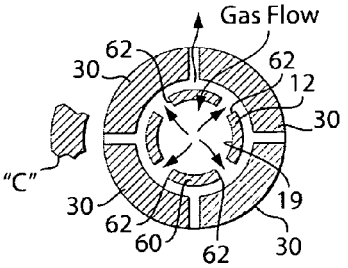
FIG. 4A is a transverse sectional view taken along the lines 4A-4A, of FIG. 3.

An annular manifold 60 is arranged circumferentially around at least one longitudinal location of preferably both the first half 14 and the second half 16 of the hollow elongated mandrel 12, as may be seen best in the exploded view of FIG. 1 and in the sectional views of FIG. 3 and FIG. 4A. Each manifold 60 has a plurality of preferably replaceable fluid discharge nozzles 62 arranged generally radially therein, as represented in FIGS. 1 and 3, and also in FIG. 4A. In another embodiment, those nozzles 62 are fixed orifices 63, generally radially configured within the annular manifold 60.

The gaseous fluid "G" entering the bore 27 in the hollow lower end barrel 23 pressurizably flows into the fluid communicative bore 19 of the mandrel 12, and through the nozzles 62 and/or 63 in the manifold 60, as the plunger assembly 12 travels within the conduit "C" of the well. The jet-like fluid pressure of the gas traveling through the first lower bore 25 in the hollow lower end barrel 23 and into the bore 19 within the elongated mandrel 12 flows radially outwardly through the nozzles 62 and/or 63 in the manifold 60, against the arcuate inner surface of the pads 30 pushing them against the walls of the conduit "C". This provides an improved sealing of the plunger assembly 12 as it travels through the well's conduit "C". The gaseous fluid escapes from radially outwardly from within the plunger assembly 12, and into the conduit "C", keeping liquid from running back downhole via movement under the pads 30, and also helps keep liquid on the top of the plunger 12. That escaping gas also lightens the liquid load on above the plunger assembly 12, so less pressure is required to provide lift to a given amount of fluid above the plunger assembly 12. The biasing of the gas "G" against the curved inside surface of the pads 30 assists the springs 36 in biasing the pads 30 radially outwardly against the conduit "C", thus providing a tighter seal between the plunger assembly 12 and the conduit "C" through which it is moving.

The replaceable nozzles 63 may be replaced when pads are changed, should different gaseous flow rates be desired by the gas "G" from the central bore 19, against the inner surface of the wear pads 30.

Thus, gaseous fluids "G" enter the lower end of the plunger assembly 12, through the central open channel 27 in the hollow lower end barrel 23 and into the main channel, the bore 19 within the mandrel 12. The gas "G" enters the manifold 60 and exits out the nozzles 62 and/or 63 therein, and jets against the inner surface of the pads 30, biasing them radially outwardly, assisting the bias springs 36 thereby. The gas "G" then also enters the conduit "C" and floats upwardly therein, lightening the load of the liquid on top of the plunger assembly 12, minimizing liquid escaping into the plunger assembly 12 and minimizing liquid passage downwardly into the conduit "C".

We claim:

1. A plunger system for maximizing the liquid lift potential of a plunger arranged for vertical travel in a conduit in a gas/oil production well, the plunger system comprising:

an elongated plunger body mandrel having an upper or first end and a second or lower end with a fluid transmitting bore extending longitudinally therethrough, from the second or lower end of the plunger body and into at least a central portion of the plunger body;

a plurality of curvilinearly shaped, replaceable wear pads arranged in a controllably radially displaceable manner on the plunger body; and at least one fluid ejecting nozzle arranged extending through a side wall of the plunger body, providing gaseous fluid communication from the bore within the mandrel to an inner surface of at least one of the wear pads on the plunger body, for directing pressurized fluid from the lower end of the plunger body onto the inner surface of the at least one pad for biasing the wear pad radially outwardly.

2. The plunger system as recited in claim 1, wherein the first or upper end of the plunger body has an attached cap member thereon.

3. The plunger system as recited in claim 2, wherein the second or lower end of the plunger body has a barrel member thereon.

4. The plunger system as recited in claim 3, wherein the barrel member has a bore extending longitudinally therethrough.

5. The plunger system as recited in claim 1, wherein wear pads have a bias spring arranged between the plunger body and the inner surface of the wear pad to radially bias its adjacent wear pad radially outwardly.

6. The plunger system as recited in claim 1, wherein the nozzle is arranged as a part of a manifold.

7. The plunger system as recited in claim 6, wherein the nozzle in the manifold is replaceable.

8. The plunger system as recited in claim 1, wherein fluid is arranged to escape the plunger body around a periphery of a wear pad.

9. The plunger system as recited in claim 1, wherein the wear pad is guided by an array of alignment members to help control radial displacement thereof.

10. The plunger system as recited in claim 1, wherein the fluid transmitting bore extending longitudinally within the body of the plunger is of tapered dimension.

11. A method of improving the flow of liquid upwardly above an upwardly moving plunger in a conduit of an oil/gas production well, comprising:

arranging a plunger system with an internal, gas communicating channel between a lower end thereof, and a generally radially directed nozzle extending through a body portion of the plunger; and ejecting gas through the generally radially directed nozzle and onto a radially inner side of a radially displaceable wear pad movably arranged on the body portion of the plunger, so as to bias the wear pad radially outwardly against the conduit, for improved sealing between the plunger and the conduit of the well in which the plunger travels.

12. The method as recited in claim 11, including:

permitting gas ejected from a nozzle to escape from the plunger between the wear pad and the body of the plunger so as to lighten any liquid above the plunger in the conduit of the well.

13. The method as recited in claim 11, including:

arranging an annular array of radially outwardly directed nozzles in a manifold radially, the annular array being arranged inwardly of an annular array of radially displaceable wear pads on the body of the plunger.

14. The method as recited in claim 11, including:

biasing the wear pads against the conduit of the well, by a combination of gas pressure and biasing springs arranged radially outwardly on the body of the plunger.

15. A method of lightening the load of liquid above an upwardly moving plunger in a conduit of an oil/gas production well, comprising:

transmitting a flow of well gas through a bore beginning in a lower end of the plunger and through a bore within the plunger;

ejecting the well gas from at least one side nozzle in fluid communication with the bore within the plunger, the side nozzle being arranged in a wall portion of the plunger, the gas being biasedly ejected onto an inner body side of a wear pad arranged on the wall of the plunger;

bubbling the ejected well gas through a route between a wear pad and the body of the plunger to permit the gas to escape into any liquid above the vertically moving plunger, so as to lighten any liquid load thereabove.

16. The method as recited in claim 15, including:

tapering the bore within the plunger so as to increase the velocity of the gas being ejected through a nozzle and against the inside surfaces of the wear pad.

17. The method as recited in claim 16, wherein each wear pad is also biased radially outwardly from the plunger by an arrangement of springs therebetween.

18. The method as recited in claim 15, wherein the side nozzle is arranged as a plurality of radially directed nozzles disposed in an annular manifold.

19. The method as recited in claim 18, wherein the plunger has a plurality of annular manifolds disposed therearound.

20. The method as recited in claim 19, wherein the well gas ejected from the manifold migrates around the body of the wear pads and into the conduit above the plunger.

* * * * *